US008979083B2

(12) United States Patent
Theurer et al.

(10) Patent No.: US 8,979,083 B2
(45) Date of Patent: Mar. 17, 2015

(54) WELDING UNIT FOR WELDING RAILS

(75) Inventors: Josef Theurer, Vienna (AT); Bernhard Lichtberger, Pregarten (AT); Heinz Mühlleitner, St. Polten (AT)

(73) Assignee: Franz Plasser Bahnbaumaschinen-Industriegesellschaft mbH, Vienna (AT)

( * ) Notice: Subject to any disclaimer, the term of this patent is extended or adjusted under 35 U.S.C. 154(b) by 957 days.

(21) Appl. No.: 13/132,661

(22) PCT Filed: Nov. 13, 2009

(86) PCT No.: PCT/EP2009/008078
§ 371 (c)(1),
(2), (4) Date: Oct. 4, 2011

(87) PCT Pub. No.: WO2010/063362
PCT Pub. Date: Jun. 10, 2010

(65) Prior Publication Data

US 2012/0025436 A1 Feb. 2, 2012

(30) Foreign Application Priority Data

Dec. 3, 2008 (AT) ..... A 1881/2008

(51) Int. Cl.
*B25B 1/18* (2006.01)
*E01B 29/46* (2006.01)

(52) U.S. Cl.
CPC ..... *E01B 29/46* (2013.01)
USPC ..... 269/25; 269/43

(58) Field of Classification Search
CPC ..... B25B 1/02; B25B 1/241; B25B 5/00; B25B 5/02; B25B 5/122
USPC ..... 269/25, 32, 20, 43, 246, 229; 254/19, 254/18
See application file for complete search history.

(56) References Cited

U.S. PATENT DOCUMENTS

| | | | | |
|---|---|---|---|---|
| 5,172,846 | A * | 12/1992 | Hayashi et al. | 228/5.7 |
| 6,105,948 | A * | 8/2000 | Young | 269/43 |
| 6,152,435 | A * | 11/2000 | Snell | 269/43 |
| 7,174,614 | B2 * | 2/2007 | Martz et al. | 29/257 |
| 2003/0141283 | A1 | 7/2003 | Theurer et al. | |
| 2007/0164494 | A1 * | 7/2007 | Chang | 269/43 |
| 2012/0025436 | A1 * | 2/2012 | Theurer et al. | 269/25 |

FOREIGN PATENT DOCUMENTS

| | | | |
|---|---|---|---|
| EP | 0499019 | A2 | 8/1992 |
| JP | 2006281261 | A | 10/2006 |

* cited by examiner

*Primary Examiner* — Lee D Wilson
(74) *Attorney, Agent, or Firm* — Laurence A. Greenberg; Werner H. Stemer; Ralph E. Locher

(57) ABSTRACT

A welding unit for welding two rails of a track is equipped with clamping jaws intended for lying against a rail web. The clamping jaws each have a sliding surface, which is at a distance from a contact surface in the transverse direction of the rail and is arcuately curved with respect to a cross section extending such that it is normal to a neutral axis of the rails. The jaw mount, intended for fixing the clamping jaw, has a sliding surface, which is curved in a way corresponding to the sliding surface of the clamping jaw, and so the clamping jaw is movable along the sliding surfaces in relation to the jaw mount.

6 Claims, 2 Drawing Sheets

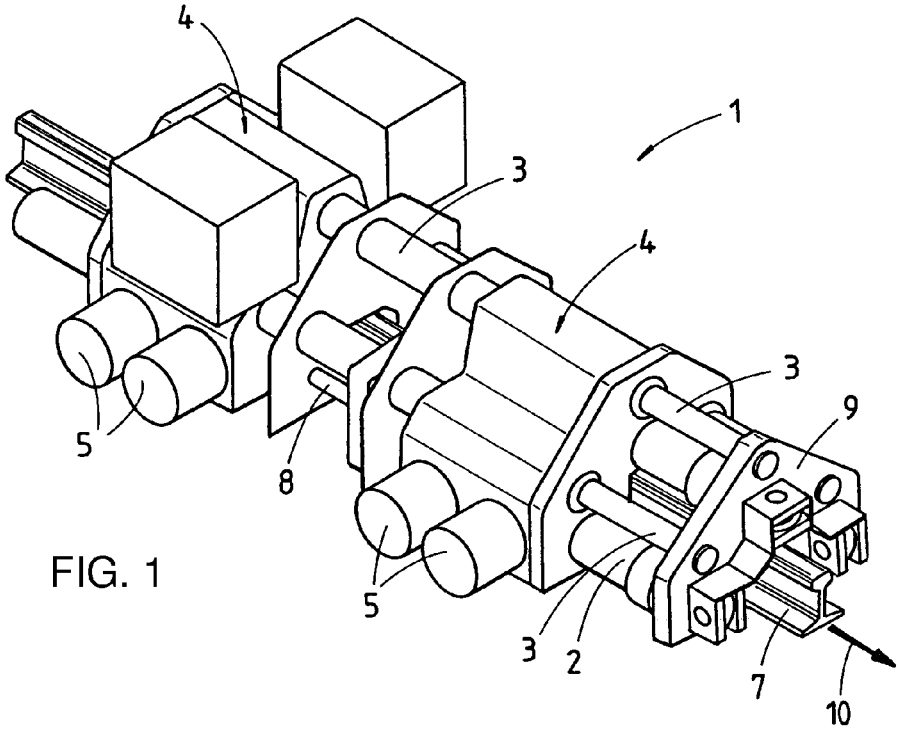
FIG. 1
FIG. 2
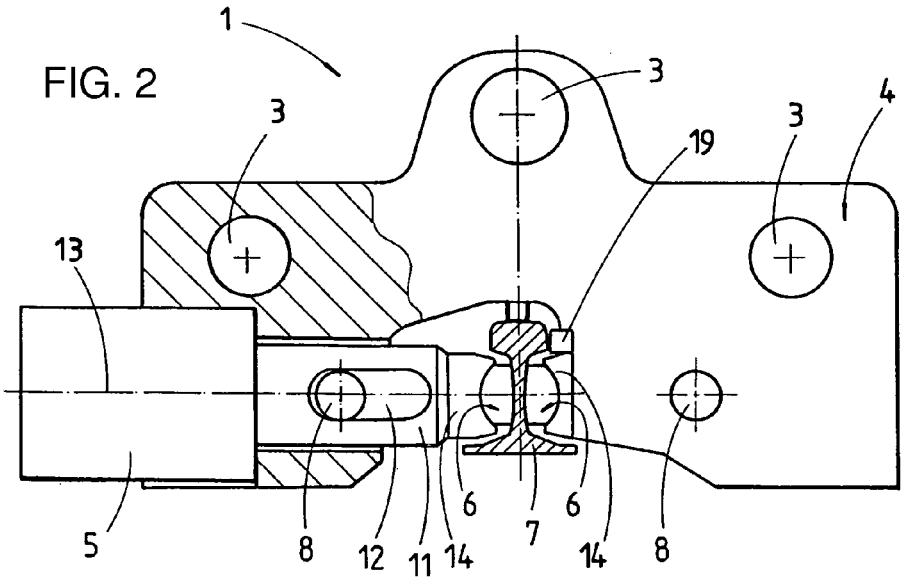

WELDING UNIT FOR WELDING RAILS

BACKGROUND OF THE INVENTION

Field of the Invention

The invention relates to a welding unit for welding two rails of a track, including two unit parts which are movable towards one another in the longitudinal direction of the rails along guides of the unit by means of displacement cylinders and are each equipped with clamping jaws having contact surfaces intended for application to a rail web.

Welding units of this kind are known, for example, from EP 0 132 227 A2 or US 2003/0141283 A1. The clamping jaws have to be pressed onto the rail web with great force in order to be able to move the rails with precision towards one another in their longitudinal direction for the upset stroke finalizing the welding operation.

BRIEF SUMMARY OF THE INVENTION

It is the object of the present invention to provide a welding unit of the type mentioned at the beginning which enables an improved transmission of great forces to the rail web.

According to the invention, this object is achieved with a welding unit of the specified kind by means of the features cited in the characterising clause of the main claim.

With the aid of the cylindrical sliding surface, the clamping jaws acquire a small degree of freedom of movement in order to be able to optimally adjust to the position of the rail web in spite of irregularities which may exist due to rail head tolerances, for example. This enables a problem-free transmission of also particularly great forces, such as are required especially for closure welding within the range of a temperature which deviates from the neutral temperature.

Additional advantages of the invention become apparent from the dependent claims and the description of the drawing.

The invention will be described in more detail below with reference to an embodiment represented in the drawing in which

BRIEF DESCRIPTION OF THE SEVERAL VIEWS OF THE DRAWING

FIG. 1 shows a view of the welding unit with two unit parts movable towards one another, FIG. 2 shows a simplified cross-section of a unit part.

DESCRIPTION OF THE INVENTION

Figure 3:
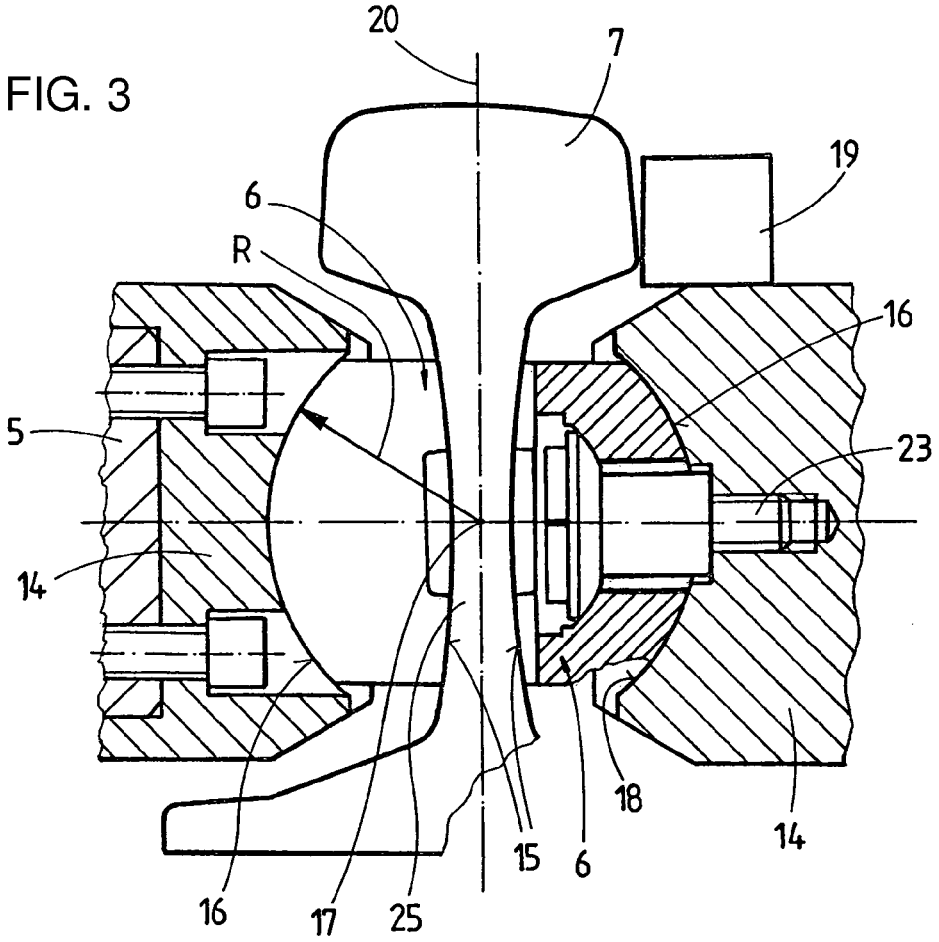
FIG. 3 shows a cross-section of clamping jaws abutting on a rail web.

A welding unit 1, represented in FIGS. 1 to 3, is composed of two unit parts 4 which are displaceable towards one another along guides 3 of the unit with the aid of displacement cylinders 2. These unit parts 4 are connected in each case to two clamping drives 5 by means of which clamping jaws 6 can be pressed onto rails 7 to be welded to one another.

Pull rods 8, extending parallel to the guides 3 of the unit, are fastened to the first unit part 4 and pass through the second unit part 4. The two pull rods 8 are connected to a crossbeam 9 to which the two displacement cylinders 2 are articulatedly connected. The clamping drives 5—extending perpendicularly to a longitudinal direction 10 of the rails—are each equipped, in the region of piston rods 11, with an opening 12 for passage of the pull rod 8.

As visible particularly in FIGS. 2 and 3, each of the clamping jaws 6—lying opposite one another in a transverse direction 13 of the rails—is supported in a jaw mount 14. One of these is fixedly connected in each case to the unit part 4, and the opposite jaw mount 14 is connected to the piston rod 11.

As shown in FIG. 3, each clamping jaw 6 has a sliding surface 16, spaced from a contact surface 15, which is curved—with respect to a cross-section extending perpendicularly to a neutral axis 17 of the rail 7—in the shape of a circular arc having a radius R. The jaw mounts 14 provided for fixation of the clamping jaw 6 also have a sliding surface 18 which is curved with the radius R in accordance with the sliding surface 16 of the clamping jaw 6. Thus, the two sliding surfaces 16, 18 form part of a cylindrical surface so that the clamping jaw 6 is movable in each case relative to the jaw mount 14 about the neutral axis 17.

The connection of each clamping jaw 6 to the associated jaw mount 14 is accomplished by means of a screw 23 which, having a correspondingly shaped head, enables the said rotatability of the clamping jaw 6 over a range of approximately 1 to 2 degrees.

As can be seen in FIGS. 2 and 3, the jaw mount 14 lying opposite the clamping drive 5 is connected to a stop bar 19 extending parallel to the longitudinal direction 10 of the rails. With this, the rails 7 to be welded can be lined up in a joint alignment. Of the two clamping jaws 6 lying opposite one another in pairs, only one is movable relative to the unit part 4 by the clamping drive 5 in a direction extending perpendicularly to a plane of symmetry 20 of the rail.

Figure 4:
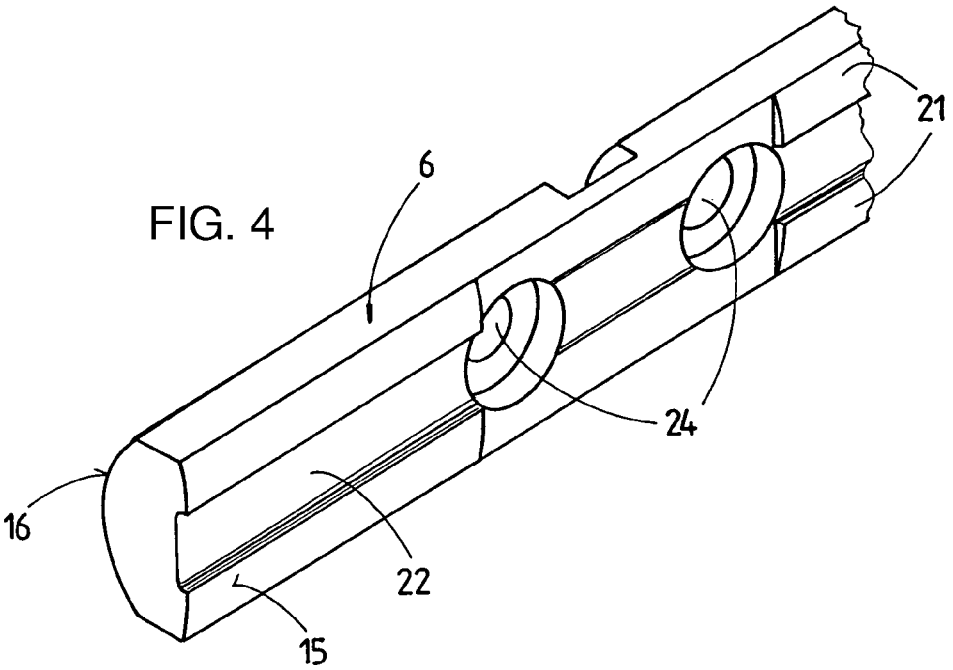
FIG. 4 shows a view of a clamping jaw.

As visible particularly in FIG. 4, the clamping jaw 6 has two contact bars 21, extending parallel to one another and in the longitudinal direction of the rail and forming the contact surface 15, which are separated from one another by a recess 22. Bores 24 are provided in each case for receiving the afore-mentioned head of the screws 23. The contact surface 15 on each clamping jaw 6 or contact bar 21 is tempered by plasma transfer arc welding for improving the force-locked connection to a rail web 25.

To initiate the welding procedure, the rails 7 are lifted by means of a lifting device (not shown) from the sleepers of the track and pressed against the stop bars 19. Subsequently, the clamping drives 5 are actuated in order to press the clamping jaws 6, connected thereto, against the rail web 25 of the rail 7 as well as to the oppositely positioned clamping jaws 6 with a clamping force of approximately 350 tons.

Now, if the two rails 7 abutting the stop bars 19 do not lie precisely in a common plane of symmetry 20 of the rail—for example, due to cross-sectional deviations within the tolerance range—there is a corresponding automatic rotation and adjustment of the clamping jaws 6. In further sequence, this enables a problem-free transmission of the great clamping forces to the rail web 25 in order to finally press the rails 7 to one another by means of the displacement cylinders 2 for the welding of said rails.

The invention claimed is:

1. A welding unit for welding two rails of a track, the welding unit comprising:

guides;

displacement cylinders;

two unit parts which are movable towards one another in a longitudinal direction of the rails along said guides by means of said displacement cylinders;

clamping jaws with contact surfaces intended for application to a rail web, each of said clamping jaws having a sliding surface, spaced from said contact surfaces in a transverse direction of the rails, said sliding surface being curved with respect to a cross-section extending perpendicularly to a neutral axis of the rails in a shape of a circular arc, each of said two unit parts equipped with said clamping jaws; and jaw mounts fixing said clamping jaws and each having a mount sliding surface being curved complementary to said sliding surface of said clamping jaws, so that said clamping jaws are movable along said sliding surface relative to said mount sliding surface of said jaw mounts.

2. The welding unit according to claim 1, wherein a circular arc center point of said sliding surface and said mount sliding surface is positioned in the neutral axis of the rails.

3. The welding unit according to claim 1, further comprising a stop bar and each of said two unit parts being associated with two of said jaw mounts, one of said two jaw mounts is connected to said stop bar intended for application to a rail head of the rail.

4. The welding unit according to claim 1, further comprising a clamping drive; and wherein each of said unit parts is equipped with two of said clamping jaws, and only one of said two clamping jaws is movable relative to said unit parts by means of said clamping drive in a direction extending perpendicularly to a plane of symmetry of the rail.

5. The welding unit according to claim 1, wherein each of said clamping jaws has a recess formed therein and two contact bars, extending parallel to one another and in the longitudinal direction of the rail and forming said contact surfaces, which are separated from one another by said recess.

6. The welding unit according to claim 5, wherein said contact surface on each of said contact bars is formed by plasma transfer arc welding.

* * * * *